United States Patent [19]

Moser

[11] 4,071,735

[45] Jan. 31, 1978

[54] EXTERNALLY HEATED LOW-POWER ROLL FUSER

[75] Inventor: Rabin Moser, Fairport, N.Y.

[73] Assignee: Xerox Corporation, Stamford, Conn.

[21] Appl. No.: 737,300

[22] Filed: Nov. 1, 1976

[51] Int. Cl.[2] ..... H05B 1/00; G03G 15/00

[52] U.S. Cl. ..... 219/216; 219/388; 250/317

[58] Field of Search ..... 219/216, 469–471, 219/388; 432/59–60, 228, 227; 250/317–319

[56] References Cited

U.S. PATENT DOCUMENTS

| | | | |
|---|---|---|---|
| 3,452,181 | 6/1969 | Stryjewski | 219/388 X |
| 3,669,707 | 6/1972 | Donnelly et al. | 432/60 X |
| 3,841,827 | 10/1974 | Thettu | 432/60 |

*Primary Examiner*—C. L. Albritton

[57] ABSTRACT

A roll fuser structure for a xerographic reproducing apparatus. The contemplated roll fuser comprises a fuser roll member having an outer layer of silicone rubber which is externally heated by a source of radiant thermal energy adapted to raise the temperature thereof to approximately 300° F. The energy source is positioned adjacent the inlet of a nip formed between the fuser roll and a backup roll such that part of the energy therefrom impinges on the fuser roll surface and part of the energy impinges on the toner images carried by the support member prior to the images being contacted by the heated fuser roll member. By so positioning the energy source, it is possible to reduce the operating temperature of the fuser roll to 300° F. and still satisfactorily fuse high density or thick images by virtue of pre-heating them by the portion of the energy which impinges on the toner images.

6 Claims, 2 Drawing Figures

EXTERNALLY HEATED LOW-POWER ROLL FUSER

BACKGROUND OF THE INVENTION

This invention relates generally to xerographic copying or reproduction apparatus and, more particularly, to a contact fusing system for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action cuases the toner to be absorbed to some extent into the fibers of the support member which, in many instances constitutes plain paper. Thereafter, as the toner material cools, solidification of the toner material occurs causing the toner material to be firmly bonded to the support member. In both the xerographic as well as the electrophotographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is heated. During operation of a fusing system of this type, the support member to which the toner images are electrostatically adhered is moved through the nip formed between the rolls with the toner image contacting the heated fuser roll to thereby effect heating of the toner images within the nip.

One type of roll fuser comprises a conformable outer layer such as silicone rubber. In order to optimize the life expectancy of such a construction and insure satisfactory release of coalesced toner carried by the substrate it should be operated at a relatively low temperature (i.e. 300° F. ). However, where only a single fuser (prior art systems are known which employ plural fusers, for example, as disclosed in U.S. Pat. No. 3,861,863) has been provided it has been necessary to operate such fuser rolls at substantially higher temperatures (i.e. 380°-400° F.) in order to adequately fuse thick or high density images.

Accordingly, it is the primary object of this invention to provide new and improved fusers for use in an electrophotographic copying apparatus.

It is a more particular object of this invention to provide an improved roll fuser capable of operating at a lower temperature yet capable of satisfactory fusing low and high density images.

BRIEF SUMMARY OF THE INVENTION

Briefly, the above-cited objects are accomplished by the provision of a roll fuser apparatus wherein a single heat source is provided in order to heat the surface temperature of the fuser member to approximately 300°

F. and to pre-heat toner images carried by the copy substrate prior to entering the nip formed between the fuser member and a backup roll member.

In order to accomplish the foregoing, the single energy source is supported adjacent the entrance to the fuser nip and externally of the roll fuser members such that a portion of the energy impinges on the surface of the fuser member and a portion of the energy impinges on the toner images carried by the substrate.

External sources of radiant energy for xerographic fuser applications are known. For example, U. S. Pat. Nos. 3,539,161 and 3,649,992 are typical of such devices. However, unlike the embodiment herein disclosed, the structures in these patents do not provide pre-heating of toner images on the copy substrates together with elevating the surface temperature of a fuser roll member, both of the foregoing being effected from a single energy source.

Other objects and advantages of the present invention will become apparent when read in conjunction with the accompanying drawings wherein:

FIG. 1 is a schematic representation of a xerographic reproducing apparatus incorporating the novel contact fuser of this invention; and FIG. 2 is a schematic plan view of a heat and contact fuser representing the present invention.

DETAILED DESCRIPTION OF THE PREFERRED EMBODIMENT

Figure 1:
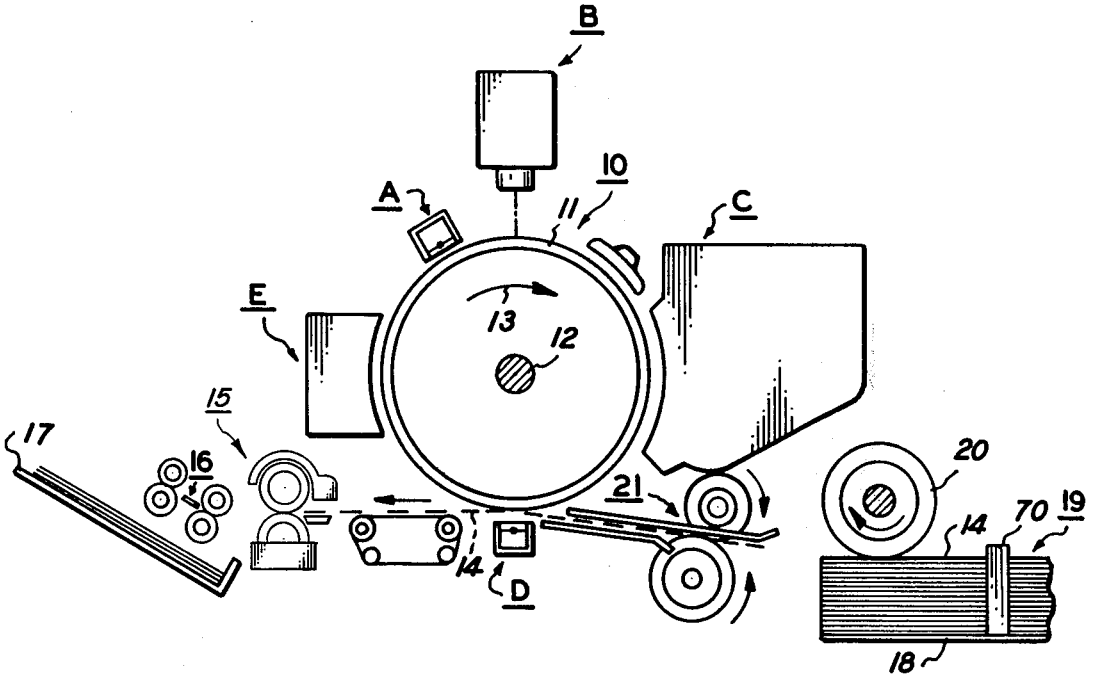

The reproducing machine illustrated in FIG. 1 employs an image recording drum-like member 10 the outer periphery of which is coated with a suitable photoconductive material 11. One type of photoconductive material is disclosed in U.S. Pat. No. 2,970,906 issued to Bixby in 1961. The drum 10 is suitably journaled for rotation within a machine frame (not shown) by means of a shaft 12 and rotates in the direction indicated by arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are herein represented in FIG. 1 as blocks A to F. Initially, the drum moves photoconductive surface 11 through a charging station A. At charging station A an electrostatic charge is placed uniformly over the photoconductive surface 11 of the drum 10 preparatory to imaging. The charging may be provided by a corona generating device of a type described in U.S. Pat. No. 2,836,725 issued to Vyverberg in 1958.

Thereafter, the drum 10 is rotated to exposure station B where the charged photoconductive surface 11 is exposed to a light image of the original input scene information, whereby the charge is selectively dissipated in the light exposed regions to record the original input scene in the form of a latent electrostatic image. A suitable exposure system may be of the type described IN U.S. patent application, Ser. No. 259,181 filed June 2, 1974.

After exposure, drum 10 rotates the electrostatic latent image recorded on the photoconductive surface 11 to development station C, wherein a conventional developer mix is applied to the photoconductive surface 11 of the drum 10 rendering the latent image visible. A suitable development station is disclosed in U.S. patent application Ser. No. 199,481 filed Nov. 17, 1971. This application describes a magnetic brush development system utilizing a magnetizable developer mix having carrier granules and toner comprising electrophotographic resin plus colorant from dyes or pigments. A developer mix is continually brought through a directional flux field to form a brush thereof. The electrostatic latent image recorded on photoconductive surface 11 is developed by bringing the brush of developer mix into contact therewith. The developed image on the photoconductive surface 11 is then brought into contact with a sheet of final support material 14 within a transfer station D and the toner image is transferred from the photoconductive surface 11 to the contacting side of the final support sheet 14. The final support material may be plain paper, gummed labels, transparencies such as Polycarbonate, Polysulfane and Mylar, etc., as desired.

After the toner image has been transferred to the sheet of final support material 14, the sheet with the image thereon is advanced to a suitable fuser assembly 15 which fuses the transferred powder image thereto. After the fusing process, the final support material 14 is advanced by a series of rolls 16 to a copy paper tray 17 for subsequent removal therefrom by a machine operator.

Although a preponderance of the toner powder is transferred to the final support material 14, invariably some residual toner remains on the photoconductive surface 11 after the transfer of the toner powder image to the final support material 14. The residual toner particles remaining on the photoconductive surface 11 after the transfer operation are removed from the drum 10 as it moves through cleaning station E. Here the residual toner particles are first brought under the influence of a cleaning corona generating device (not shown) adapted to neutralize the electrostatic charge remaining on the toner particles. The neutralized toner particles are then mechanically cleaned from the photoconductive surface 11 by conventional means as for example, the use of a resiliently biased knife blade as set forth in U.S. Pat. No. 3,660,863 issued to Gerbasi in 1972.

The sheets of final support material 14 processed in the automatic xerographic reproducing device may be stored in the machine within a removable paper cassetts 18. A suitable paper cassette is set forth in U.S. patent application Ser. No. 208,138 filed Dec. 15, 1971.

The copier can also have the capability of accepting and processing copying sheets of varying lengths. The length of the copy sheet, of course, being dictated by the size of the original input scene information recorded on the photoconductive surface 11. To this end, the paper cassette 18 is preferably provided with an adjustable feature whereby sheets of varying length and width can be conveniently accommodated therein.

In operation, the cassette 18 is filled with the stack of final support material 19 of pre-selected size and the cassette 18 is inserted into the machine by sliding along a baseplate (not shown) which guides the cassette 18 into operable relationship with a pair of feed rollers 20. When properly positioned in communication with the feed rollers 20 the top sheet of the stack 19 is separated and forwarded from the stack 19 into the transfer station D by means of registration rollers 21.

It is believed that the foregoing description is sufficient for purposes of present application to illustrate the general operation of an automatic xerographic copier which can embody the teachings of the present invention.

Figure 2:
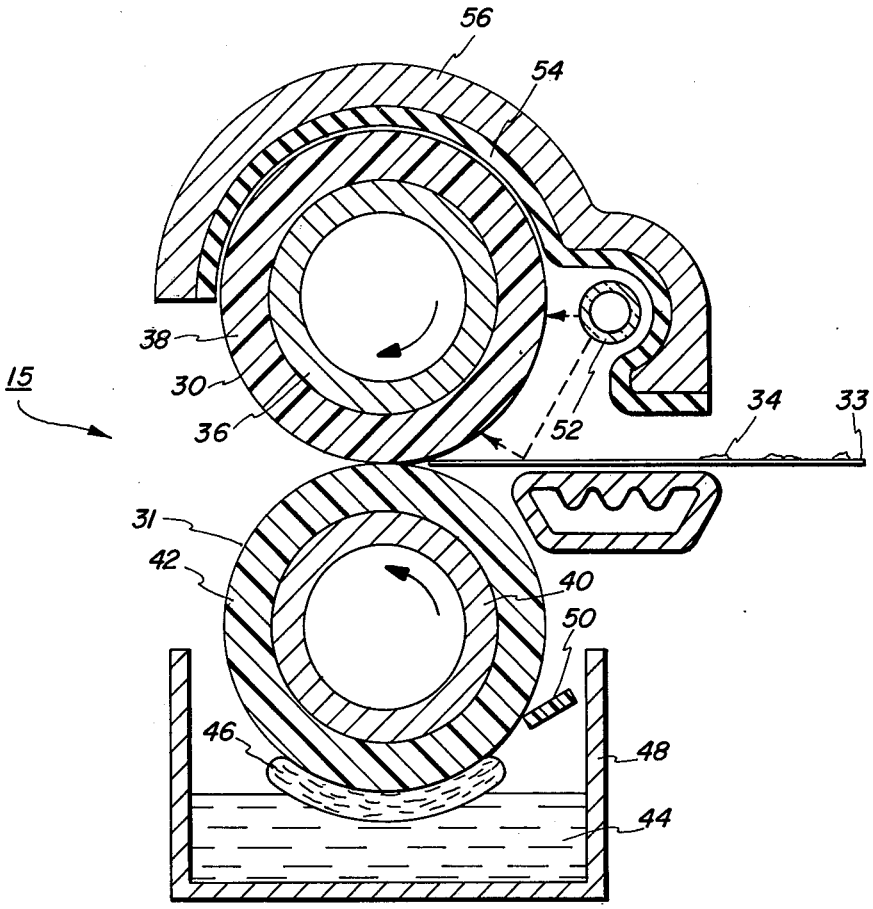

As shown in FIG. 2 direct contact fusing of powder images onto copy substrates is achieved by forwarding the substrates between a heated upper roller generally designated 30 which rotates in contact with a lower backup roll 31 with pressure being applied such that the rolls 30 and 31 form a nip 32 therebetween. A copy substrate 33 carrying unfused toner images 34 is moved through the nip of the rollers such that the toner images contact the upper heated roll. While the orientation of the rolls 30 and 31 has been disclosed in the manner shown in FIG. 2, other orientations are possible and perhaps more desirable depending upon the overall machine configuration.

The heated roll 30 comprises a metallic core or cylinder 36 having a layer 38 of heat insulating silicone rubber affixed to the outer surface thereof which has a radial thickness of sufficient dimension and conformability as to permit very small indentations thereof by the toner images when the roll 31 is in pressure contact therewith. The layer 38 may in turn be coated with a thin coating (not shown), at room temperature, of vulcanizing compounds such as Dow-Corning release agent 236, produced by the Dow-Corning Company. Since this material, as such, is highly reflective, it is preferred that it be mixed with approximately 55 by weight of Dow-Corning RTV 735 Sealant Adhesive which diminished the reflective quality of the basic materal without affecting the release quality thereof and thereby greatly enhancing the heat absorbing ability of the coating with the blanket.

The lower roll 31 comprises a metallic core 40 having a combination layer 42 of insulating abhesive material such as Teflon and silicone rubber, the former of which is provided as the outer surface.

A thin film of release material 44 may be applied to the pressure roll by means of a wick 46 which is supported in contact with the pressure roll and serves to convey release material from a sump 48 containing a quantity of the material. The material may be silicone oil having a viscosity of 100cs which is metered to the desired thickness by means of a metering blade 50 supported in contact with the backup roll.

A source 52 of radiant energy, for example a quartz lamp is provided for elevating the surface temperature of the fuser roll 30 to apprioximately 300° F. and also being capable of pre-heating the toner images on the copy substrates prior to their entry into the nip. A reflector 54 is provided for re-directing energy emanating from the back surface of the lamp 52 and impinging thereon toward the fuser roll surface and the copy substrates. An insulator 56 is provided as a backing for the reflector in order to minimize thermal heat losses by radiation from the backside of the reflector.

The lamp is adapted to operate at 2500° K with an input of 950 watts thereto. With the foregoing values and a radiated output of 86% approximately 40% of the energy from the lamp is directed to the roll and another 40% is directed to the paper, approximately 60% being absorbed by the reflector. A copy substrate with 10% image coverage reflects nearly 60% of the energy incident threon, which will be absorbed by the roll. Accordingly, approximately 64% or 610 watts is incident on the roll.

The geometry of the lamp 52 and the path of the substrate 33 is such that half the lamp output can be concentrated over a one-inch section of the substrate.

For a 14-inch lamp after the radiation and reflectivity losses are taken into account energy incident and absorbed in the image areas on the paper is 27 watts per square inch. At 11 inches per second the images 34 absorb 2.5 joints per square inch. The calculated temperature rise of 60° F. or a pre-nip image temperature (ambient temperature of 70° F.) of 130° F. To a first order approximation this is sufficient to reduce the fuser roll temperature requirement to 320° F. Since the final temperature reached is well below the boiling point of water and the dwell time at this temperature is short (i.e. less than 0.1 second) no paper drying is anticipated.

As compared to prior art devices requiring 1110 watts to maintain the fuser roll surface at 400° F, the foregoing represents a 15% reduction in power. By itself, such a power reduction may not appear to be significant. However, combined with other objectives, for example, much lower roll operating temperature (i.e. 300° F.) and good copy quality, the reduction in power represents an additional benefit.

While the invention has been described in conjunction with the preferred embodiment it will be appreciated that various modifications without departing from the spirit and scope of the invention will become apparent, it is intended that such modifications be covered in the claims appended hereto.

What is claimed is:

1. Contact fuser apparatus for fusing toner images to copy substrates by passing the copy substrates through a nip formed between a pair of fuser members, said apparatus comprising:

a single source of radiant thermal energy, said radiant source of thermal energy being positioned adjacent the inlet of the nip of said fuser apparatus and externally of the fuser members so that a portion of said energy is directed toward one of said fuser members, said portion of said energy being sufficient to elevate the surface of said one of said fuser members to a level capable of fusing at least low density images; and said position of said radiant thermal energy being such that another portion of this energy is directed toward toner images carried by said copy substrates whereby said another portion impinges upon said toner images prior to said copy substrate entering said nip, said another portion serving to pre-heat high density toner images.

2. Apparatus according to claim 1 wherein said pair of fuser members comprises roll structures.

3. Apparatus according to claim 2 wherein said one of said fuser members comprises a relatively thick outer layer of silicone rubber.

4. Apparatus according to claim 3 including means for applying a release agent to the surface of the other of said fuser members.

5. Apparatus according to claim 1 wherein said energy source is sufficient to elevate the surface temperature of said fuser member to 300° F. and simultaneously elevate the temperature of said toner images by 60° F.

6. Apparatus according to claim 1 including means at least partially surrounding said at least one fuser member for minimizing the loss of heat energy therefrom.

* * * * *